United States Patent [19]

Conklin et al.

[11] Patent Number: 4,892,557

[45] Date of Patent: Jan. 9, 1990

[54] PROCESS FOR FORMING CREPE FABRICS AND FOR TEMPORARILY STABILIZING HIGH TWIST FILAMENT YARN IN THE MANUFACTURE OF SUCH FABRICS

[75] Inventors: Delano M. Conklin, Burlington; Joe F. London, Jr., Greensboro, both of N.C.

[73] Assignee: Burlington Industries, Inc., Greensboro, N.C.

[21] Appl. No.: 923,279

[22] Filed: Oct. 27, 1986

[51] Int. Cl.[4] ..... D03D 15/04; D06C 23/04

[52] U.S. Cl. ..... 8/497; 26/10.4; 26/18.5; 26/69 A; 26/DIG. 1; 28/156; 28/166; 28/167; 28/168; 28/169; 139/426 TW; 139/434; 428/152; 428/229; 428/258

[58] Field of Search ..... 8/497; 26/18.5, 69 A, 26/DIG. 1; 28/156, 166, 167, 168, 169; 139/426 TW, 434, 435; 428/152, 229, 258

[56] References Cited

U.S. PATENT DOCUMENTS

| | | |
|---|---|---|
| 2,771,660 | 11/1956 | Ephland . |
| 2,771,760 | 11/1956 | Burleson . |
| 2,772,191 | 11/1956 | Burleson . |
| 2,857,653 | 10/1958 | Ephland . |
| 3,036,423 | 5/1962 | Stoddard et al. . |
| 3,407,590 | 10/1968 | Woods . |
| 3,626,724 | 12/1971 | Wignall et al. . |
| 4,042,662 | 8/1977 | Corbin, Jr. et al. . |
| 4,130,603 | 12/1978 | Tanaka et al. . |

FOREIGN PATENT DOCUMENTS

| | | |
|---|---|---|
| 025292 | 3/1974 | Japan . |
| 080340 | 8/1974 | Japan . |
| 126366 | 7/1985 | Japan . |
| 943358 | 7/1982 | U.S.S.R. . |

OTHER PUBLICATIONS

Article entitled "Weaving of High-Twist Polyester Blend Yarns", pp. 167-180, by Paliwal et al, from *Blended Textiles* (Papers of the 38th All India Textile Conference), Gulrajani, M. L. (Editor), The Textile Association, India (1981).

Article entitled "OE Applications", pp. 58-62, by Smisek and Stary, *Textile Asia* (1983).

*Primary Examiner*—James C. Cannon

*Attorney, Agent, or Firm*—Nixon & Vanderhye

[57] ABSTRACT

A process for forming crepe fabrics on a shuttleless loom is provided which includes temporary stabilization of highly twisted (e.g., 40-70 TPI) filament yarn. To this end, hot melt size is applied at a predetermined temperature in predetermined amounts (e.g., add-on of about 10.5-13.5%) immediately after twisting so as to reduce the liveliness of the yarn and to thereby permit it to be woven. After weaving, the yarn stabilization is reversed by a desizing operation. The fabric is subsequently heat treated to develop crepe characteristics.

5 Claims, 2 Drawing Sheets

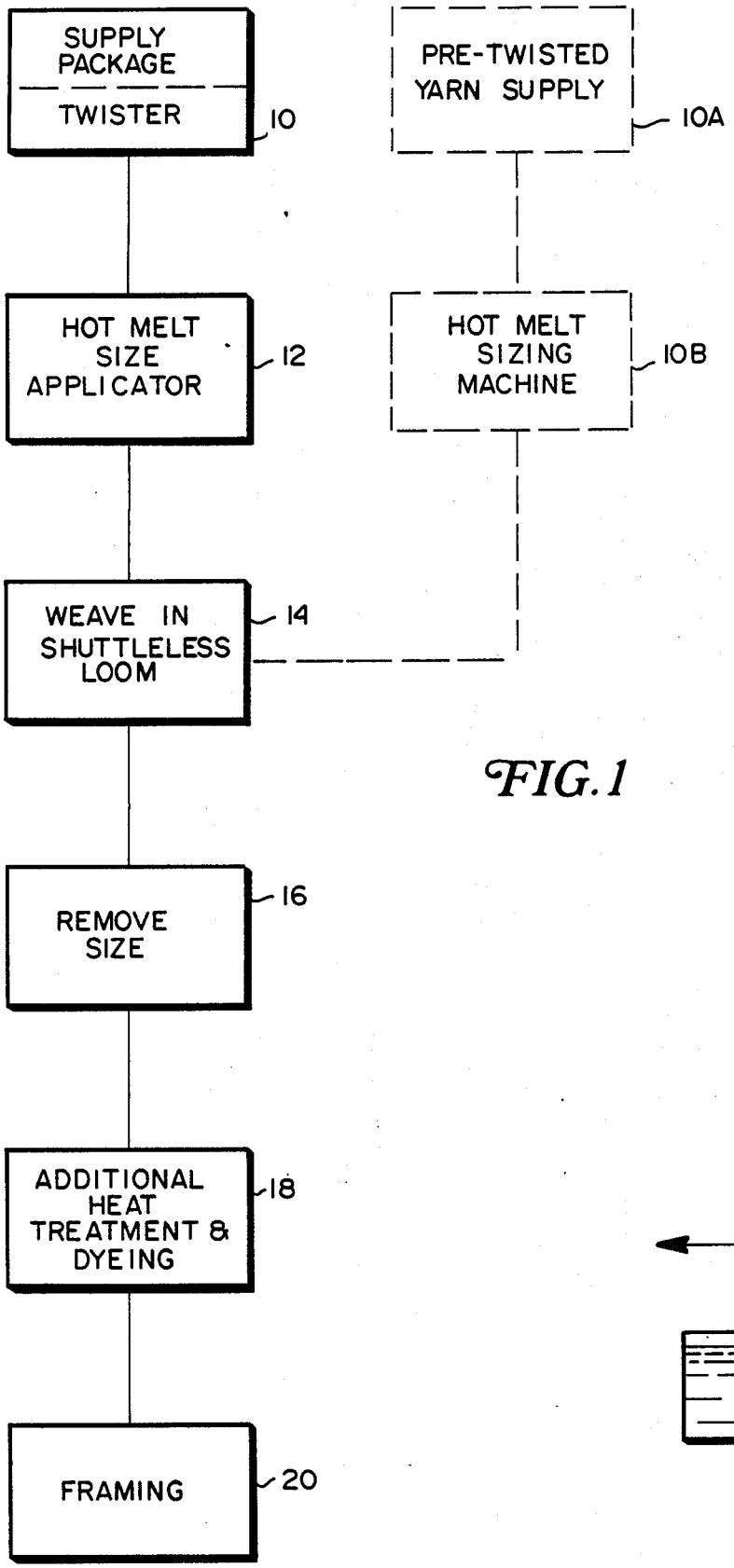
FIG. 1
FIG. 3
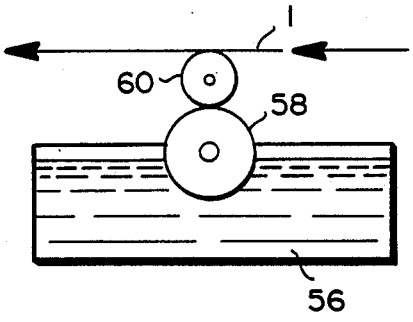

PROCESS FOR FORMING CREPE FABRICS AND FOR TEMPORARILY STABILIZING HIGH TWIST FILAMENT YARN IN THE MANUFACTURE OF SUCH FABRICS

BACKGROUND OF THE PRESENT INVENTION

In the past, continuous filament fabrics have been developed to imitate silk in appearance, hand and drape by twisting 40–100 denier continuous multifilament yarn to a level of 40 to 70 TPI, weaving them on conventional fly shuttle looms, and subsequently developing the crepe of the fabric by boiling the fabric in a relaxed state for an extended period of time.

High twist yarn of this type, however, proves difficult to process, in part because of the snags, kinks and general tangling caused by the liveliness of the yarn, particularly as it leaves the supply package. In the past, attempts have been made to stabilize the yarn through additional process steps, such as conditioning the yarn by steaming in the 139°–140° F. range for extended periods of time, e.g., up to four hours. After heat treatment, the yarn may be sized, using conventional sizing materials such as polyvinyl alcohol, polyacrylic acid and carboxyl methyl cellulose, woven and, finally, exposed to scouring and boiling operations. See, for example, U.S. Pat. No. 2,857,653, issued Oct. 28, 1958.

In U.S. Pat. No. 2,772,191, issued Nov. 27, 1956, conventional sizing is applied to twisted yarn to reduce the liveliness of the yarn, followed by knitting and removal of the size.

It is also known to add tension and anti-snag devices on the supply package to prevent kinking and snarling as the twisted yarn is wound onto a quill. During the subsequent weaving operation, it is known to use a shuttle equipped with fur and nylon loops to control kinking of the yarn coming off the quill. There may also be a tension device in the shuttle itself, just before the shuttle eye, to keep the yarn tight as it is being pulled across the shed of the warp.

After weaving, the woven cloth is typically processed through a creeping operation which subjects the fabric in a relaxed state to a gradual rise in temperature, up to between 210° and 250° F. in an aqueous bath. A pressure rotary washer may be required to reach temperatures above 212° F. The developed fabric is subsequently dyed and finished.

With the development of high speed looms such as the water jet and air jet looms, however, and the automation of related operations, the steps usually required to produce a good crepe fabric using high twist yarn have become costly if not almost impossible to carry out. For example, in the prior art as noted hereinabove, the liveliness of the high twist yarn could be controlled through utilization of a tension device in the shuttle just ahead of the shuttle eye to keep the yarn tight as it was being pulled across the shed of the warp. With water or air jet looms, the yarn has to be at very low tension to be carried across the shed with a burst of water or air. To compensate for this reduction in tension control, higher temperatures must be employed during conditioning of the yarn prior to weaving in order to control the liveliness of the yarn. However, the higher temperatures reduce the creping power of high twist yarns. Additional finishing equipment required to overcome part of this lost tendency to develop crepe is costly in terms of both labor and equipment.

SUMMARY OF THE INVENTION

It is an object of this invention to provide a process which permits the weaving of highly twisted yarns on water jet and air jet looms without the higher conditioning temperatures heretofore required in prior art processes. Accordingly, the present invention allows the development of crepe type fabric products from high twist yarns, using water and air jet looms with conventional automated finishing equipment.

In the present invention, high twist filament yarns are temporarily stabilized after twisting to a level which permits weaving on high speed weaving machines, after which time the stabilization is reversed. Specifically, the present invention, in one exemplary embodiment thereof, calls for the following steps:

(a) highly twisting a continuous filament yarn;

(b) applying a predetermined amount of hot melt size at a predetermined temperature to temporarily stabilize the yarn by reducing its liveliness, and to allow the high twist yarn to be woven on high speed weaving machines;

(c) backwinding the yarn onto a weft delivery package;

(d) weaving the yarn into a fabric on a shuttleless loom, i.e., an air or water jet loom;

(e) reversing the stabilization of the yarn by desizing in order to restore the original liveliness to the yarn; and (f) subjecting the fabric to further heat treatment to develop its crepe characteristics.

Thus, the primary objective of this invention is to produce crepe fabric at relatively low cost and in a relatively simple manner, using high twist yarn and shuttleless looms of the air or water jet type, and without resort to the high temperature liveliness control techniques employed in the prior art which tend to otherwise reduce the creping characteristics of high twist yarns. Further objectives will become apparent from the detailed description which follows.

BRIEF DESCRIPTION OF THE DRAWINGS

FIG. 1 is a schematic block diagram indicating the steps to be carried out in the process according to an exemplary embodiment of the invention;

FIG. 3 is a schematic diagram illustrating an alternative hot melt size applicator.

DETAILED DESCRIPTION OF THE DRAWINGS

Figure 2:
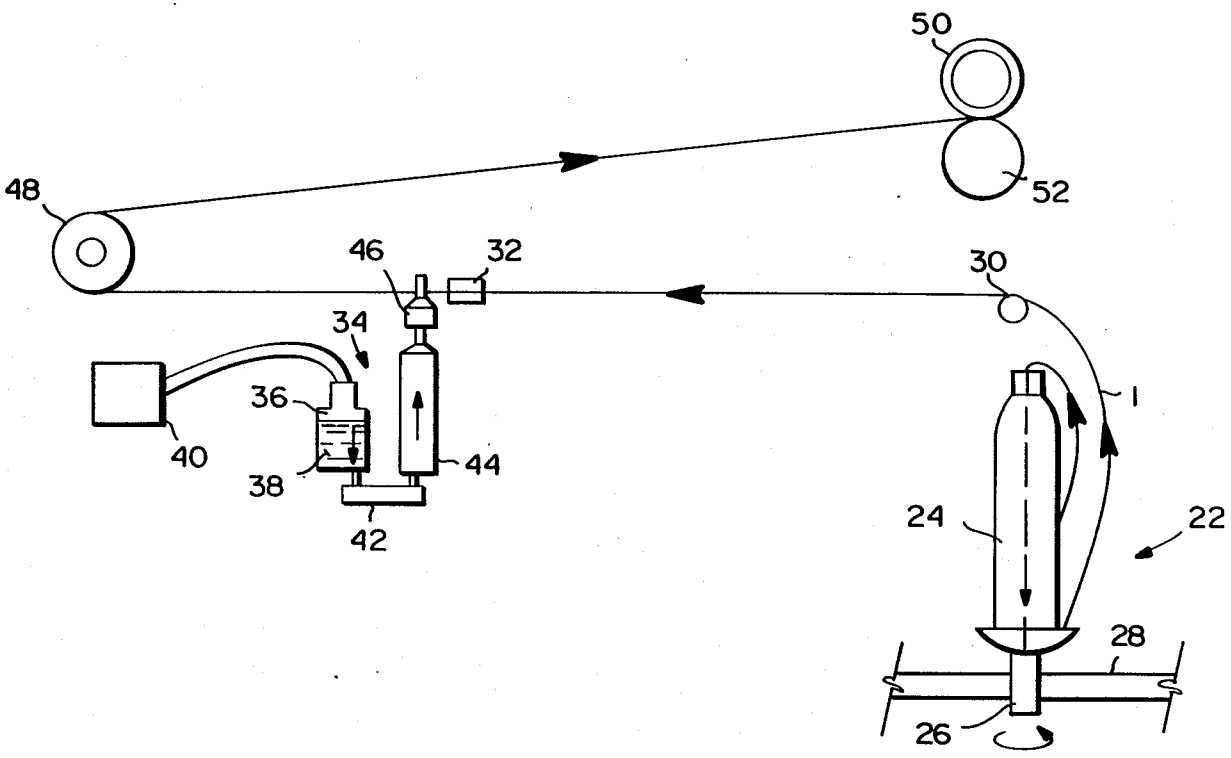
FIG. 2 is a schematic diagram illustrating the twisting and the sizing steps in accordance with a preferred embodiment of the invention.

Referring to FIG. 1 of the drawings, illustrated therein is a box diagram indicating the sequence of steps to be followed in carrying out an exemplary embodiment of the process of this invention.

Preferably, the hot melt sizing application takes place while inserting twist into the yarn. The twisting operation itself, carried out at a first station 10, involves twisting 40–100 denier yarn which may be nylon, polyester or other polymer, to a level of about 40–70 TPI on a two-for-one twister, with half the yarn having a Z-twist and the other half having an S-twist. In a preferred example, 70 denier yarn is twisted to 62 TPI.

Because the yarn is sized immediately after twisting in the preferred method, yarn speed is limited by the speed of rotation of the spindle, and may be as slow as about 10 yds./min.

As the twisted yarn leaves the twister 22, it is sized at station 12 in accordance with controlled conditions of heating and add-on, resulting in a high twist filament yarn with greatly reduced liveliness. The applied hot melt size preferably comprises a formulation of 48% Dow Primacor 5991 (ethylene acrylic acid copolymer), 48% hydrogenated tallow, and 4% dodecanedioic acid. With this formulation, an add-on between about 10.5 and 13.5% (preferably about 12%) with application temperatures of 290° F. to 300° F. have been found to be optimal. This is because if the temperature drops much below 290° F., the size will not adhere well to the yarn. In fact, if the temperature drops to between 275° F. and 280° F., the size components will separate. On the other hand, the temperature must be high enough to maintain the sizing formulation fluid, but not so high as to negatively impact on the desired yarn properties.

The amount of add-on must be high enough to stabilize the yarn effectively, but only temporarily. An add-on of 10.5% is adequate with the above-noted size formulation, but other formulations may require only a 7% add-on. Also, with the identified formulation, add-ons of over about 13.5% are wasteful and may even alter the heat history of the yarn. On the other hand, with different size formulations, add-ons of 15% and higher may be required.

In any event, the size formulation should be determined according to the known heat setting temperatures or melting points of the various yarn fibers, such as nylon, polyester, and so on.

Referring to FIG. 2, apparatus is disclosed for performing the described twisting and hot melt sizing operations. At station 10, a conventional two-for-one twister 22 may be employed, including a supply package 24 and a spindle 26. The spindle 26 is driven by a drive belt 28 in a conventional manner. From the twister, the yarn 1 is passed around a yarn guide 30, through a vortex nozzle 32, and immediately to a hot melt size applicator 34. In FIG. 2, the applicator is shown to be of the orifice type, which includes a heated reservoir 36 of molten hot melt size 38, and a low pressure air supply source 40. Heated pipes 42 and 44 direct the pressurized hot melt size to the orifice applicator 46 where the size is applied to the yarn. Thereafter, the yarn is passed around yarn guide roll 48 and wound on a package 50 by drum drive 52 preparatory to weaving.

The hot melt size may be also applied by other conventional methods, including utilization of grooved rolls or over kiss applicators. Apparatus and method for applying hot melt size to textile yarns are disclosed in U.S. Pat. No. 3,862,475, reissued as U.S. Pat. No. Re. 29,287 on July 5, 1977. In FIG. 3, an alternative applicator is illustrated which includes a hot melt size bath 56, a rubber doctor roll 58 and a three-quarter inch grooved applicator roll 60. As the applicator roll 60 rotates, it receives size from the engaged doctor roll 58 which is at least partially immersed in the hot melt size bath 56.

In an alternative embodiment of the present invention, pre-twisted yarn from a supply station 10A can be supplied directly to a hot melt sizing machine at 10B, as indicated by the sequence of steps in phantom lines in FIG. 1. Since the sizing operation is not tied to the twisting operation in this embodiment, the yarn speed may be increased to about 150 yds./min. The yarn speed during sizing is thus seen to be dependent on whether or not the yarn is being twisted in the same operation, and is not necessarily dependent to any significant extent on the type of yarn being processed.

After the hot melt size has been applied, the yarn is backwound onto a weft delivery package and subsequently woven at station 14 into fabric on a shuttleless loom of the air or water jet type at, for example 525 ppm, alternating the S and Z yarns.

Following weaving, the fabric is subjected to a scouring operation at station 16. Preferably, scouring is carried out utilizing a multi-compartmental desizing bath having an initial temperature of about 130° F. and a final temperature of about 175° F. Treatment time for the fabric is preferably from about two to five minutes.

The temperature gradient associated with the multi-compartmental desizing bath actually helps to begin the development of the crepe of the fabric, particularly because this arrangement avoids shocking the fabric with a high temperature bath normally used in desizing. Such high temperature baths, while adequate and, in some cases, necessary for desizing, tend to heat set the yarns in fabrics and thus hinder subsequent crepe development.

In carrying out the scouring operation, the fabric may be passed through the multi-compartmented bath and subsequently fed through a pair of squeeze rollers. Alternatively, the desizing bath may be applied by passing the fabric through a series of roller pairs wherein the desizing is carried by the lower roller, and wherein the desizing temperature is gradually increased from about 130° F. to about 175° F.

Following the scouring operation, the fabric is placed, in a relaxed state, in a jet beck at station 18 where the temperature is gradually raised from about 150° F. to about 240° F. to develop the crepe of the fabric. The fabric may then be dyed in the same beck and thereafter framed at station 20.

The resulting product is considerably improved in terms of its silk-like character compared to fabrics produced according to prior art methods. The fabric is characterized by "scroop" which is the rustling sound heard when the fabric is brushed against itself, and by an improved hand. In addition, the fabric is further characterized by "buttery roll" which is the capability of draping naturally in all directions, a property particularly sought after for styling women's cowl neck blouses.

The crepe fabric produced in accordance with this invention, and prior to its formation into finished garments, is further characterized by selvage which, unlike fabrics woven on a shuttle loom where weft yarns are turned back to form the next weft course, may have either a feathered edge consisting of severed weft yarns or a tucked selvage.

Having set forth the nature, objects and advantages of the present invention, it will be apparent that changes and alterations may be made therein without departing from the spirit and scope of the invention as defined by the following claims.

What is claimed is:

1. A crepe fabric comprising highly twisted continuous filament yarn woven on a shuttleless loom after having been treated with a hot-melt size, half the yarn having Z-twist and half the yarn having S-twist, said fabric characterized by the appearance, hand and drape of silk and having a selvage consisting of severed weft yarns.

2. A crepe fabric as defined in claim 1 wherein the filament yarn is a 70 denier, 72 filament yarn twisted to 62 TPI.

3. A crepe fabric comprising highly twisted continuous filament yarn woven on a shuttleless loom after having been treated with a hot-melt size, half the yarn having Z-twist and half the yarn having S-twist, said fabric characterized by the appearance, hand and drape of silk and having a tucked selvage.

4. A crepe fabric produced by the steps of:

(a) twisting a continuous filament yarn to a level of about 40–70 TPI followed immediately by;

(b) applying a hot melt size at a temperature of about 290°–300° F. with an add-on of between about 10.5 and 13.5% to said yarn to stabilize the yarn such that the liveliness of the yarn is temporarily reduced;

(c) backwinding the yarn onto a weft delivery package;

(d) weaving a fabric from said yarn on a shuttleless loom;

(e) desizing the woven fabric to restore the original liveliness to the fabric yarns; and (f) heat treating the fabric to develop crepe characteristics.

5. A crepe fabric produced by the steps of:

(a) highly twisting a continuous filament yarn followed immediately by;

(b) temporarily reducing the liveliness of the yarn by applying a hot melt size at a temperature of about 290°–300° F. with an add-on of between about 10.5 and 13.5%;

(c) weaving a fabric from said yarn on a shuttleless loom;

(d) restoring the liveliness of the yarn by desizing the woven fabric; and (e) gradually raising the temperature of the fabric to about 240° F. to develop the crepe of the fabric;

(f) dyeing the fabric; and (g) framing the fabric.

* * * * *